US006181903B1

(12) United States Patent
An

(10) Patent No.: US 6,181,903 B1
(45) Date of Patent: Jan. 30, 2001

(54) DEVELOPING ROLLER CLEANING APPARATUS OF LIQUID PRINTER

(75) Inventor: Hyung-jin An, Suwon (KR)

(73) Assignee: Samsung Electronics Co., Ltd., Kyungki-do (KR)

( * ) Notice: Under 35 U.S.C. 154(b), the term of this patent shall be extended for 0 days.

(21) Appl. No.: 09/494,045

(22) Filed: Jan. 31, 2000

(30) Foreign Application Priority Data

Jan. 30, 1999 (KR) ..... 99-3050

(51) Int. Cl.[7] ..... G03G 15/10

(52) U.S. Cl. ..... 399/237; 399/348; 399/351; 15/256.5

(58) Field of Search ..... 399/237, 249, 399/348, 351, 283; 430/117; 15/256.5, 256.51, 256.52

(56) References Cited

U.S. PATENT DOCUMENTS 5,708,937 * 1/1998 Lestrange et al. ..... 399/239
5,937,247 * 8/1999 Takeuchi et al. ..... 399/237
5,999,778 * 12/1999 Chang et al. ..... 399/237

* cited by examiner

*Primary Examiner*—Richard Moses
(74) *Attorney, Agent, or Firm*—Sughrue, Mion, Zinn, Macpeak & Seas, PLLC

(57) ABSTRACT

A developing roller cleaning apparatus for a liquid printer includes a cleaning brush rotating in contact with a developing roller so that developer adhering to an outer circumferential surface of the developing roller can be cleaned, a blade holder, and a blade installed to be bent as the blade contacts the developing roller for removing foreign material back-plated on the developing roller after being cleaned by the cleaning brush, one end of the blade being coupled to the blade holder and the other end thereof contacting the outer circumferential surface of the developing roller. The blade has a blade interference $\delta=(R-r)$, a blade leading edge pressure P, and a cleaning angle $\theta_2$ satisfying the below conditions of $1.0\ mm \lesssim \delta \lesssim 1.5\ mm$, $10\ g/cm \lesssim P \lesssim 20\ g/cm$, and $5° \lesssim \theta_2 \lesssim 20°$. Here, R denotes the radius of the developing roller and r denotes the distance between the center of the developing roller and a leading edge of the blade assuming that an elastic bias applied to the blade installed to be bent is removed.

3 Claims, 3 Drawing Sheets

DEVELOPING ROLLER CLEANING APPARATUS OF LIQUID PRINTER

BACKGROUND OF THE INVENTION

1. Field of the Invention

The present invention relates to a developing roller cleaning apparatus for a liquid printer, and more particularly, to a developing roller cleaning apparatus for a liquid printer adopting a blade thus increasing the efficiency of cleaning.

2. Description of the Related Art

A liquid electrophotographic printer such as a liquid laser printer is known as a liquid printer. The liquid electrophotographic printer forms an electrostatic latent image by scanning a laser beam onto a photoreceptor medium, develops the image with developer including toner of a predetermined color using a development unit, and transfers the developed image to a print paper to print the image.

The liquid electrophotographic printer, as shown in FIG. 1, includes a laser scanning unit (LSU) for forming an electrostatic latent image on a photoreceptor web 10 and a developing unit 20 for developing an image corresponding to the electrostatic latent image.

The developing unit 20 includes a development reservoir 21, a developing roller 23 disposed to maintain a predetermined development gap G between itself and the photoreceptor web 10, a developing roller cleaning unit 30 for removing developer adhering to the developing roller 23. An injection unit 25 for injecting the developer including toner and carrier toward the development gap G, a squeegee roller 27 for separating the toner from the carrier by pressing the photoreceptor web 10, and a blade 29 for cleaning the developer adhering to the squeegee roller 27 where a drip line (DL) is removed.

The developing roller cleaning apparatus 30 includes a pipe 31 having a hole formed therein and an injection hole 31 a and a cleaning roller 33 inserted around the pipe 31 for contacting and cleaning the developing roller 23. The cleaning roller 33 contacting the developing roller 23 cleans the developing roller 23 by means of developer injected through the injection hole 31 a of the pipe 31.

However, as the conventional developing roller cleaning apparatus having the above structure is not provided with a means to remove foreign materials adhering to the developing roller 23 after cleaning, the efficiency of cleaning is lowered so that the quality of printing is deteriorated.

SUMMARY OF THE INVENTION

To solve the above problems considering the above conditions, it is an objective of the present invention to provide a developing roller cleaning apparatus for a liquid printer capable of improving the efficiency of cleaning and preventing fixation and damage to the developing roller by adopting a blade and setting the position and installation angle of the blade.

Accordingly, to achieve the above objective, there is provided a developing roller cleaning apparatus for a liquid printer which comprises a cleaning brush rotating in contact with a developing roller so that developer adhering to an outer circumferential surface of the developing roller can be cleaned; a blade holder, and a blade installed to be bent as the blade contacts the developing roller for removing foreign material back-plated on the developing roller after being cleaned by the cleaning brush, one end of the blade being coupled to the blade holder and the other end thereof contacting the outer circumferential surface of the developing roller. The blade has a blade interference $\delta=(R-r)$, a blade leading edge pressure P, and a cleaning angle $\theta_2$ satisfying the below conditions of $1.0\ mm \lesssim \delta \lesssim 1.5\ mm$, $10\ g/cm \lesssim P \lesssim 20\ g/cm$, and $5° \lesssim \theta_2 20°$. Here, R denotes the radius of the developing roller and r denotes the distance between the center of the developing roller and a leading edge of the blade assuming that an elastic bias applied to the blade installed to be bent is removed.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
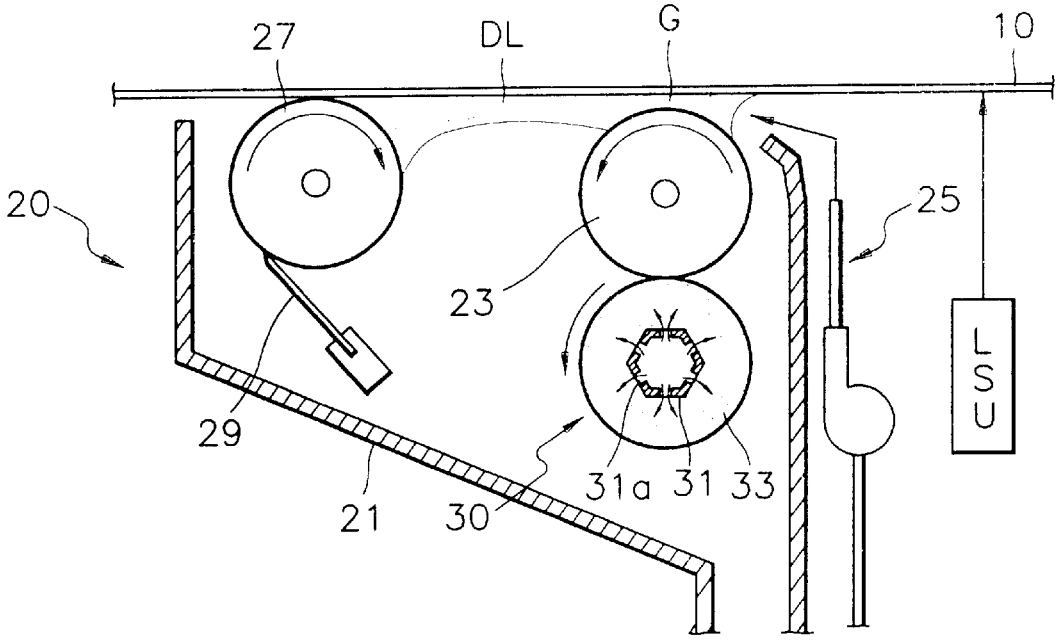
FIG. 1 (PRIOR ART)
FIG. 1 is a view showing a conventional developing roller cleaning apparatus for a liquid printer.
Figure 2:
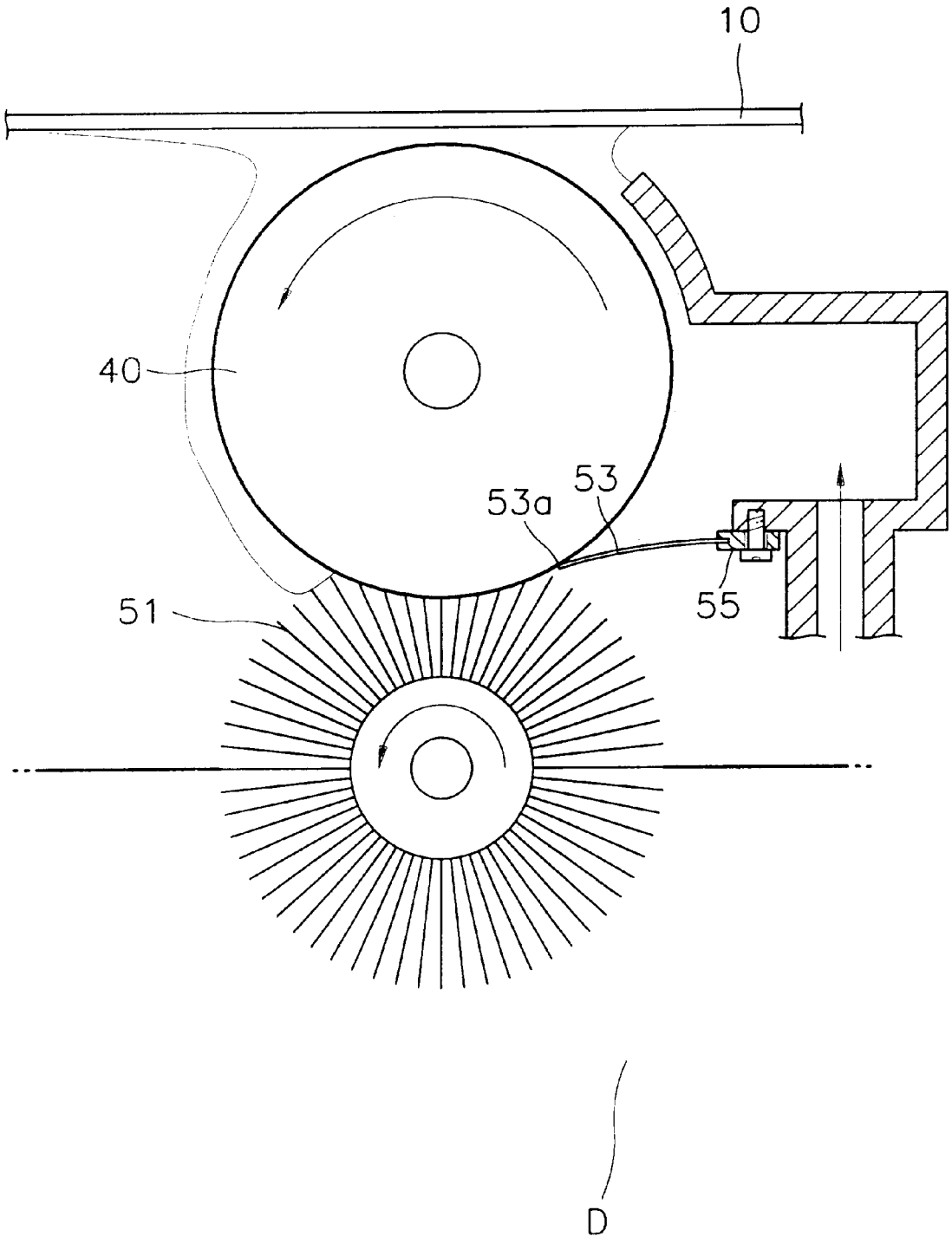
FIG. 2 is a side view showing a developing roller cleaning apparatus for a liquid printer according to a preferred embodiment of the present invention.
Figure 3:
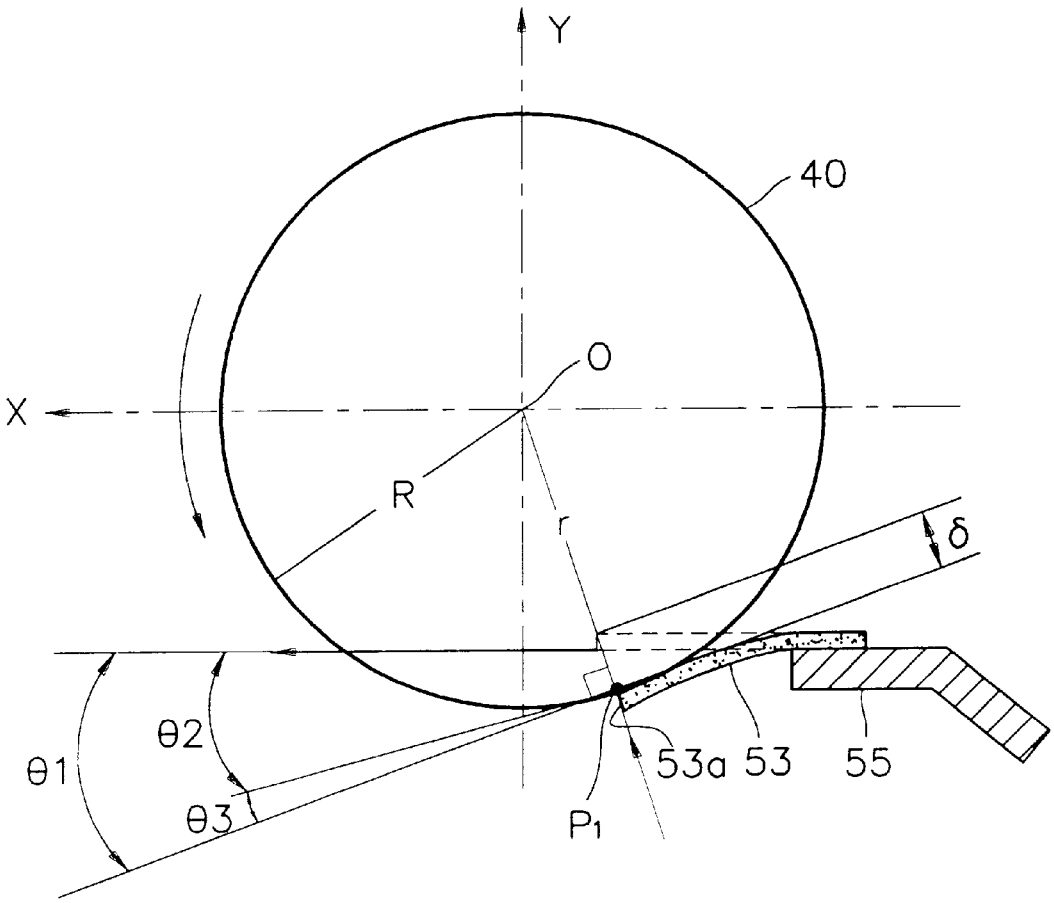
FIG. 3 is a view showing the arrangement of the developing roller cleaning apparatus for a liquid printer according to a preferred embodiment of the present invention.

Referring to FIGS. 2 and 3, a developing roller cleaning apparatus according to the present invention includes the cleaning brush 51 rotating in contact with the developing roller 40 and partially submerged into developer D during cleaning for cleaning developer adhering to an outer circumferential surface of the developing roller 40, a blade holder 55, and the blade 53 for removing foreign materials back-plated to the developing roller 40 after being cleaned by the cleaning brush 51 while one end thereof is fixedly coupled to the blade holder 55 and the other end contacting the outer circumferential surface of the developing roller 40.

In the developing roller cleaning apparatus having the above structure, the blade 53 should meet the following conditions.

First, all developer which is back-plated on the developing roller after development should be cleaned.

Second, the blade should not damage the surface of the developing roller.

Third, ink should not be fixed to the surface of the blade after cleaning.

Fourth, the rotation speed of the developing roller should not be affected by the pressure applied by the blade.

The blade 53 is made of urethane and the leading edge 53a contacts the outer circumferential surface of the developing roller 40. The blade 53 is installed to be slanted a predetermined angle with respect to the tangent line of the developing roller 40 in a counter-trail direction, that is, a direction opposite the rotation direction of the developing roller 40. Here, the blade 53 does not bend in a trail direction due to the rigidity and material characteristic thereof. Thus, a holding volume phenomenon of the developer D does not occur.

The blade 53 is preferably disposed to be bent as it contacts the developing roller 40 such that the pressure applied to the outer circumferential surface of the developing roller 40 can increase due to an elastic bias. The degree of bending can be represented by blade interference amount $\delta$. Here, $\delta=R-r$ in which R denotes the radius of the developing roller 40 and r denotes the distance between the center of the developing roller 40 and the leading edge 53*a* of the blade 53 assuming that the elastic bias applied to the blade 53 installed to be bent is removed.

Also, the capability of cleaning can be optimized by setting the pressure P[g/cm] of the leading edge 53*a*, the thickness t[mm] of the blade 53, the free length L[cm] of the blade 53, and the blade cleaning angle $\theta_2$[deg], within a predetermined scope.

The pressure P of the leading edge 53*a* is pressure applied to the developing roller 40 at the leading edge 53*a*, that is, at a cleaning area, which can be represented in Equation 1.

$$P = \frac{3\delta_{max}E\left(\frac{1}{12}t^3\right)}{L^3} \times 1000 \text{ [g/cm]} \quad \text{[Equation 1]}$$

Here, $\delta_{max}$ denotes the maximum deformation amount of the blade 53 and E denotes the elastic rate [g/cm$^3$] of tension. The free length L of the blade 53 is the length from the end portion of the blade holder 55 to the leading edge 53*a*. Also, $\theta_3$ denotes the sagging angle of the blade 53 and satisfies Equation 2.

$$\theta_3 = \frac{3\delta_{max}}{2L} \times \frac{180}{\pi} \text{ [deg.]} \quad \text{[Equation 2]}$$

The blade deformation angle $\theta_1$ is the angle between a definite straight line perpendicular to the definite straight line $\overline{OP_1}$ and the X axis. Here, the point $P_1$ is a point where the blade 53 and the developing roller 40 contact each other and the point O is the center of the developing roller 40.

The blade cleaning angle $\theta_2$ is the angle obtained by subtracting the blade sagging angle $\theta_3$ from the blade deformation angle $\theta_1$.

TABLE 1

| | Item | Design |
|---|---|---|
| 1 | Material and thickness of the blade | urethane 1.2/1.5/2.0 mm |
| 2 | Tension elastic rate of the blade | 45,000 g/cm$^2$ |
| 3 | Color and concentration of developer | cyan 3% |
| 4 | Speed of developing roller | 5.2 inch/sec |
| 5 | Difference in development electric potential | 200 Volts |

Table 1 shows conditions for determining the above values. The cleaning state of the developing roller 40 is measured by changing the thickness t of the blade 53 made of urethane to 1.2 mm, 1.5 mm and 2.0 mm under the conditions indicated in Table 1.

Table 2 indicates the cleaning state per thickness of the urethane blade under the conditions indicated in Table 1, that is, optimal positional coordinates, the blade free length L, the blade deformation amount δ, the blade deformation angle $\theta_1$, the cleaning angle $\theta_2$, the blade sagging angle $\theta_3$, and the cleaning leading edge pressure P.

TABLE 2

| Item | Thickness 1.2 mm | Thickness 1.5 mm | Thickness 2.0 mm |
|---|---|---|---|
| Optimal positional coordinates (X, Y) [mm] | (5.1, −8.11) | (5.79, −6.61) | (3.17, −8.74) |

TABLE 2-continued

| Item | Thickness 1.2 mm | Thickness 1.5 mm | Thickness 2.0 mm |
|---|---|---|---|
| Blade free length (L) [cm] | 0.4 | 0.4 | 0.6 |
| Blade deformation amount (δ) [cm] | 0.042 | 0.12 | 0.07 |
| Blade deformation angle ($\theta_1$) [deg.] | 32.16 | 41.21 | 19.94 |
| Cleaning angle ($\theta_2$) [deg.] | 23.1 | 15.42 | 9.92 |
| Blade sagging angle ($\theta_3$) [deg.] | 9.02 | 25.78 | 10.02 |
| Cleaning leading edge pressure (P) [g/cm] | 12.75 | 71.2 | 29.17 |
| Cleaning state | good (large driving load) | good (roller scratch) | good (roller scratch) |

In consideration of the above results, when the cleaning leading edge pressure P is under 10 g/cm, the efficiency of cleaning is lowered. When the P is over 29 g/cm, the surface of the developing roller is scratched and there is high possibility of a phenomenon in which reverse bending of the blade in the other direction occurs.

When the blade cleaning angle $\theta_2$ is equal to or less than 5°, the efficiency of cleaning is lowered. When the blade cleaning angle $\theta_2$ is equal to or greater than 20°, a frictional force between the developing roller 40 and the blade 53 increases so that a driving load increases and abnormal noise is generated.

In consideration of the above, it is preferable that the blade deformation amount δ=(R—r), the blade leading edge pressure P. and the cleaning angle $\theta_2$ satisfy Equation 3.

$$1.0 \text{ mm} \le \delta \le 1.5 \text{ mm } 10 \text{ g/cm} \le P \le 20 \text{ g/cm } 5° \le \theta_2 \le 20° \quad \text{[Equation 3]}$$

As described above, in the developing roller cleaning apparatus according to the present invention, urethane is selected as the material for the blade to be suitable for cleaning conditions and the blade interference and the blade pressure angle conditions are restricted, so that the developer back-plated on the developing roller can be cleaned without damaging the surface of the developing roller. Also, ink is not fixed on the blade after cleaning and the rotational speed of the developing roller is barely affected by the pressure applied by the blade.

What is claimed is:

1. A developing roller cleaning apparatus for a liquid printer comprising:

a cleaning brush rotating in contact with a developing roller so that developer adhering to an outer circumferential surface of said developing roller can be cleaned;

a blade holder; and a blade installed to be bent as said blade contacts said developing roller for removing foreign material back-plated on said developing roller after being cleaned by said cleaning brush, one end of said blade being coupled to said blade holder and the other end thereof contacting the outer circumferential surface of said developing roller, wherein said blade has a blade interference δ=(R—r), a blade leading edge pressure P, and a cleaning angle $\theta_2$ satisfying the below conditions of $$1.0 \text{ mm} \le \delta \le 1.5 \text{ mm } 10 \text{ g/cm} \le P \le 20 \text{ g/cm } 5° \le \theta_2 \le 20°$$

wherein R denotes a radius of said developing roller and r denotes a distance between a center of said developing roller and a leading edge of said blade assuming that an elastic bias applied to said blade installed to be bent is removed.

2. The apparatus as claimed in claim 1, wherein said blade is made of urethane.

3. A developing roller cleaning apparatus for a liquid printer comprising:

a cleaning brush, partially submerged in developer liquid during cleaning, said cleaning brush rotating in contact with a developing roller disposed above said cleaning brush, so that developer adhering to an outer circumferential surface of said developing roller can be cleaned;

a blade holder disposed proximate to said developing roller; and a blade having one end installed in said blade holder and another end contacting the outer circumferential surface of said developing roller, said blade being slanted at a predetermined angle with respect to a tangent line of said developing roller in a direction opposite a rotation direction of said developing roller, said blade contacting said developing roller to remove foreign material back-plated on said developing roller after being cleaned by said cleaning brush;

wherein said blade is made of a material which has sufficient rigidity such that said blade does not bend in a rotation direction of said developing roller.

* * * * *